United States Patent [19]

Francoeur et al.

[11] Patent Number: 4,604,003

[45] Date of Patent: Aug. 5, 1986

[54] METHOD AND APPARATUS FOR RETENSIONING PRESTRESSED CONCRETE MEMBERS

[76] Inventors: Ronald A. Francoeur, 59 Elm St., Salisbury, Mass. 01950; Verne L. Schellhorn, P.O. Box 199, 32987 Highway 1 South, Gualala, Calif. 95445

[21] Appl. No.: 750,047

[22] Filed: Jun. 27, 1985

Related U.S. Application Data

[63] Continuation of Ser. No. 437,899, Feb. 22, 1983, abandoned.

[51] Int. Cl.[4] ..... E02D 5/10; E04C 3/26; E04C 5/08

[52] U.S. Cl. ..... 405/256; 52/223 L; 52/726; 52/741; 405/252

[58] Field of Search ..... 405/231–233, 405/239, 243, 250–252, 256; 52/223 L, 230, 726, 223 R, 224, 741; 254/29 A; 29/452

[56] References Cited

U.S. PATENT DOCUMENTS

| | | | |
|---|---|---|---|
| 2,430,879 | 11/1947 | Kohn | 405/243 |
| 3,029,490 | 4/1962 | Middendorf | 52/223 L |
| 3,184,219 | 5/1965 | Simms | 254/29 A |
| 3,194,536 | 7/1965 | Simms | 254/29 A |
| 3,382,680 | 5/1968 | Takano | 52/726 X |
| 3,399,434 | 9/1968 | Kelly | 52/230 X |
| 3,491,431 | 1/1970 | Pewitt | 29/452 |
| 3,658,296 | 4/1972 | Yegge | 52/230 X |
| 3,701,509 | 10/1972 | Stinton | 52/223 L X |
| 3,762,027 | 10/1973 | Burtelson | 29/452 |
| 3,787,957 | 1/1974 | Andrews | 29/452 |
| 3,844,023 | 10/1974 | Surribas et al. | 254/29 A X |
| 3,899,891 | 8/1975 | Kelly et al. | 405/251 |
| 3,937,607 | 2/1976 | Rodormer | 52/223 X |
| 4,127,002 | 11/1978 | DeWitt | 405/239 |
| 4,407,106 | 10/1983 | Beck | 52/726 X |

FOREIGN PATENT DOCUMENTS

| | | | |
|---|---|---|---|
| 941137 | 2/1974 | Canada | 52/230 |
| 783624 | 9/1957 | United Kingdom | 405/251 |

*Primary Examiner*—Cornelius J. Husar
*Assistant Examiner*—Nancy J. Stodola
*Attorney, Agent, or Firm*—Richard J. Birch

[57] ABSTRACT

A method and apparatus for retensioning the development length of strands of an elongated prestressed concrete member is provided in which the ends of the strands are exposed, a metallic plate having tapered holes therein is placed over the ends of the strands, retaining wedges are inserted into the tapered holes of the plate to grip the ends of the strands, and a predetermined amount of tension is applied to the strand and maintained in the strand by the retaining wedges. A jack is provided to apply the tension to the strand. The prestressed concrete members such as piling, may be spliced together by using the apparatus on adjoining ends of piling.

13 Claims, 13 Drawing Figures

METHOD AND APPARATUS FOR RETENSIONING PRESTRESSED CONCRETE MEMBERS

This is a continuation of co-pending application Ser. No. 437,899 filed on Feb. 22, 1983, abandoned.

BACKGROUND OF THE INVENTION

The present invention relates to strengthening the end portions of prestressed concrete members which contain strands extending through the length of the concrete member. The present invention also relates to a method and apparatus for splicing together two or more prestressed concrete members.

Splicing mechanisms are known in the prior art. For example, the Silvander, U.S. Pat. No. 4,196,557, teaches a splicing apparatus in which metallic plates are attached to the ends of concrete members. However, the plates in this device are threaded onto reinforcing rods which extend into the concrete pile. The present invention, in contrast, relates to prestressed concrete members having strands extending therethrough as opposed to reinforcing rods. The strands are relatively more difficult to work with than the reinforcing rods.

Another example of pile splices is the Grazel U.S. Pat. No. 3,545,214 which again relates to piles having reinforcing rods rather than strands extending therethrough.

The Burtelson U.S. Pat. No. 3,762,027 relates to a method of post-tensioning prestressed concrete in which tapered anchors are used in conjunction with strands. The Burtelson method is limited to post-tensioning and utilizes rather expensive sleeve mechanisms to cover the length of the strand extending through the concrete member. The present invention does not require post-tensioning of the entire strand or the use of sleeves. Other less pertinent splicing mechanisms are shown in U.S. Pat. Nos. 4,009,550; 3,988,899; 3,650,553. Less pertinent anchoring devices are shown in U.S. Pat. Nos. 3,820,832; 3,399,434; 3,895,879; and 3,912,406.

U.S. Pat. No. 3,579,931 discloses a method for post-tensioning tendons which requires a rather complex method of bending the ends of said tendons.

The Yegge U.S. Pat. No. 3,597,830 discloses method and apparatus for post-tensioning tendons in which a pair of jacks are utilized. As pointed out above, post-tensioning either requires the use of sheathing material around the strand or substantially over-stressing the strand beyond the working stress to overcome frictional effects, either of which rather substantially increases the cost of the finished member.

U.S. Pat. No. 3,029,490 teaches the use of headed wires or other fairly complex positive end anchorage to avoid the use of sheathing in post-tensioning. The present invention utilizes much simpler connectors at the ends of the strands and does not require post-tensioning the entire strand.

U.S. Pat. No. 3,163,904 teaches a strand chuck used to grip tendons in prestressed concrete members. This patent does not teach a splicing mechanism or a method for pretensioning the end portion of the strands.

SUMMARY OF THE INVENTION

The present invention provides a method and apparatus in which the end portion of prestressed strands are retensioned to essentially equalize the tension throughout the length of the strand. This invention is a rather simple and inexpensive method of retensioning the ends of the members. Furthermore, the present invention provides a simple and inexpensive method and apparatus for splicing two or more prestressed concrete members together.

The present invention may be utilized when the prestressed concrete member is being initially cast, or, alternately, the invention may be utilized after the member has been cast and shipped to the job site. That is, the invention may be used as a "retrofit" in addition to being used as the member is initially formed.

A metallic plate having tapered holes formed therein is applied to the end of a prestressed member, with the ends of the strands extending through the holes in the metallic plate. Retaining means are provided between the plate and the strand which serve to maintain tension in the strand after retensioning has been accomplished by a novel jack provided as one aspect of this invention.

A primary object of the invention is to provide an improved method and apparatus for retensioning the ends of a prestressed concrete member.

A further object of the invention is to provide a method and apparatus for splicing two or more prestressed concrete members together.

Other objects and advantages of the invention will become apparent from the specification and the drawings in which.

DETAILED DESCRIPTION OF PREFERRED EMBODIMENTS

Figure 1:
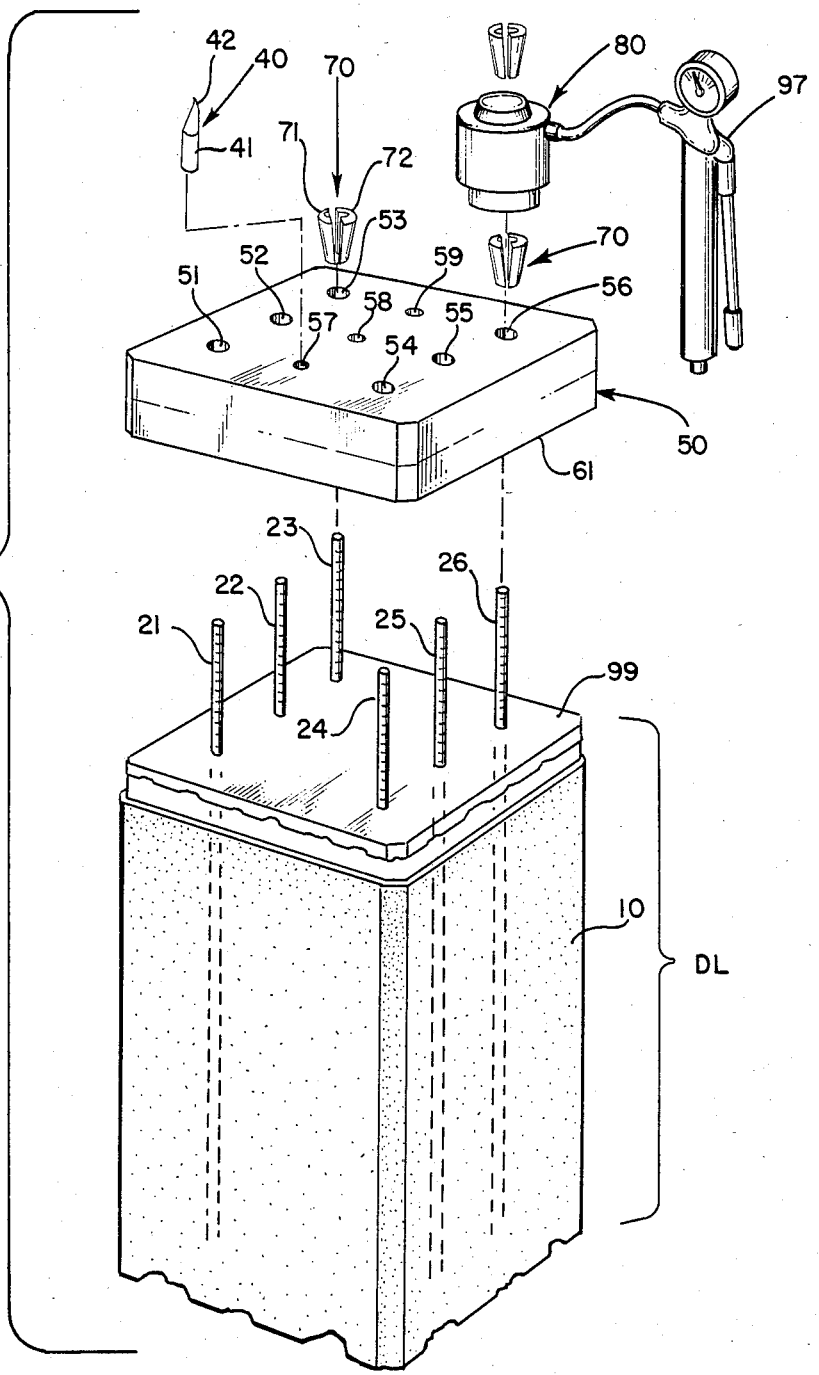
FIG. 1 is an exploded view of a prestressed concrete pile utilizing the invention in a retrofit situation.

FIG. 1 shows a prestressed concrete pile 10 having six strands 21–26 extending through the entire length of pile 10.

Plate means 50 is a piece of steel having a plurality of tapered holes 51–56 extending therethrough. The holes 51–56 are formed in plate means 50 so that they will receive the ends of strands 21–26 as plate means 50 is lowered into its position shown in FIG. 3.

Three additional holes 57, 58 and 59 may be provided in plate means 50 which serve a centering function which will be described in greater detail below. Skirt 61 extends around the periphery of plate means 50.

Retaining means 70 are tapered strand chucks formed by half sections 71 and 72 and are carried by holes 51–56 of plate means 50. Jack means 80 is utilized to retension the ends of strands 21–26 after the plate means 50 has been placed over the ends of the strands and retaining means 70 has been placed into position.

Figure 2:
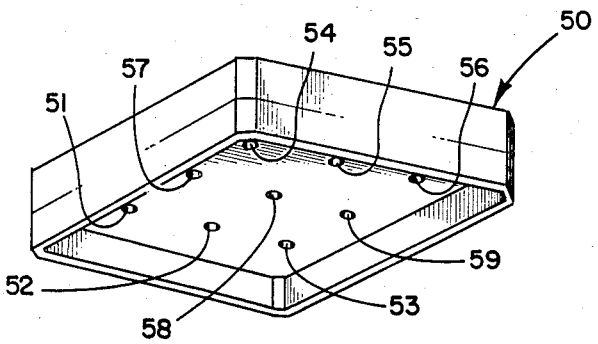
FIG. 2 illustrates by a perspective view a plate used in conjunction with the invention.

FIG. 2 shows plate means 50 from an underneath perspective showing the bottoms of holes 51–59 formed in plate means 50.

As shown in FIG. 1, the "development length" of strands 21–26 is represented by the legend DL. As used herein, the phrase "development length" refers to that length of each strand having less tension than the working tension remaining in the strand after the prestressing has been completed and the ends of strands 21–26 exposed as shown in FIG. 1. For example, the ends of strands 21–26 will obviously have zero tension whereas at the center of pile 10, each strand may have 30 kips tension. The "development length" will be that length of the strand at the end of each strand in which the tension increases from zero to 30 kips. As a rule of thumb, the "development length" is approximately 50 times the diameter of the given strand.

Figure 3:
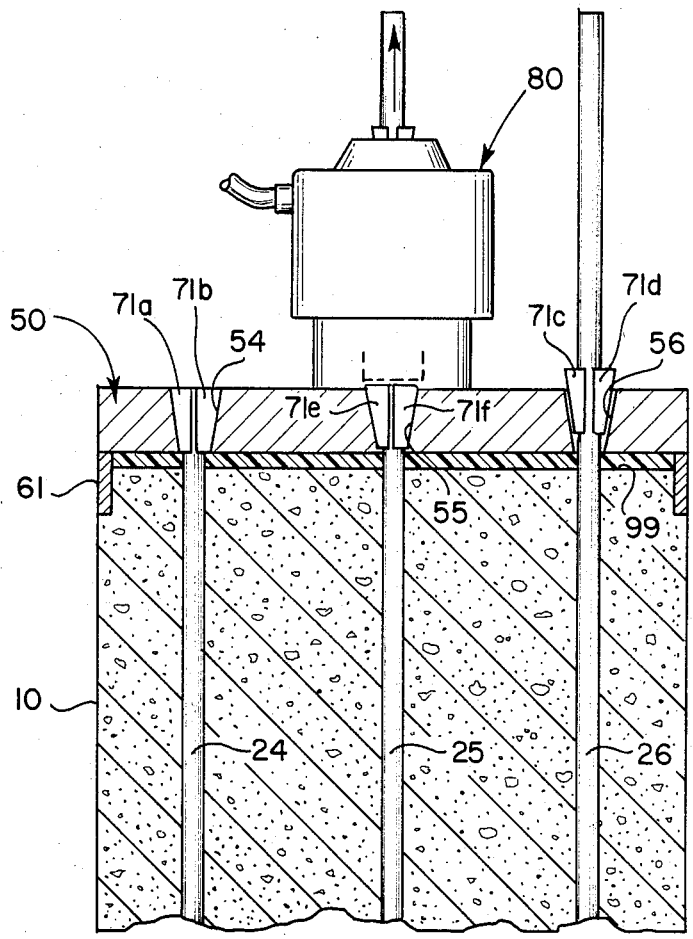
FIG. 3 is an elevational view, partially in sections, of the components of FIG. 1 being assembled.

FIG. 3 shows the end of pile 10 with plate means 50 in position on the end of pile 10 with the ends of strands 21–26 extending through tapered holes 51–56. As shown in FIG. 3, the end of strand 24 has been retensioned by jack means 80 and anchored by retaining wedges 71*a* and 71*b*. Jack means 80 is shown retensioning the development length of strand 25. Strand 26 is shown prior to retensioning with retaining wedges 71*c* and 71*d* being slid into position in tapered hole 56.

A layer of epoxy cement 99 is shown which is typically utilized in retrofit applications of the invention. That is, if pile 10 is delivered to the job site without the ends of strands 21–26 being exposed as shown in FIG. 1, the concrete is cut or broken away for a length of approximately six inches to expose the ends of strands 21–26 as shown in FIG. 1. The layer of epoxy 99 is applied to correct the uneven surface of concrete attained after cutting or otherwise breaking off the last six inches of concrete from pile 10.

Figure 4:
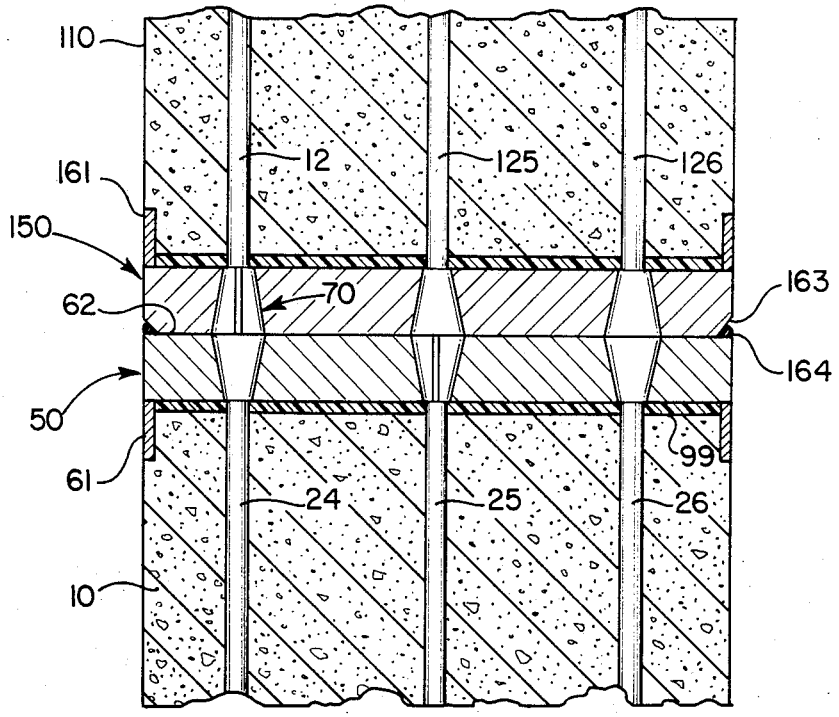
FIG. 4 is a sectional view of the splice provided by this invention.

FIG. 4 shows the splice provided by this invention. The splice is provided between concrete member 10 which may be a pile, for example, and concrete member 110. After the ends of strands 24, 25 and 26 (as well as the ends of strands 21, 22 and 23) have been retensioned as shown in FIG. 3, the ends of the strands are cut off so that the upper surface 62 of plate means 50 is flat and unobstructed. Strands 124, 125 and 126 in concrete member 110 are similarly retensioned and cut off so that the lower surface of plate means 150 is flat and unobstructed. A bevel 163 is formed around the periphery of plate 150 so that a continuous bead of welding 164 may be applied. As shown in FIG. 4, the continuous bead of welding 164 and the interaction of skirts 61 and 161 with the concrete in members 10 and 110 provide a seal which prevents moisture and other of the natural elements from reaching the retaining means 70 and greatly reduces or even prevents corrosion or deterioration of retaining means 70.

As shown in FIG. 4, the splice provided by this invention is exceedingly strong. For most piling, a one quarter inch bead of welding results in a splice of greater strength than either pile 10 or 110. The splice is effective in transmitting tensile, compressive, shear and bending forces between piles 10 and 110. The components of the splice may be applied on the job site or may be applied in a casting yard as will be described in greater detail below.

Figure 5:
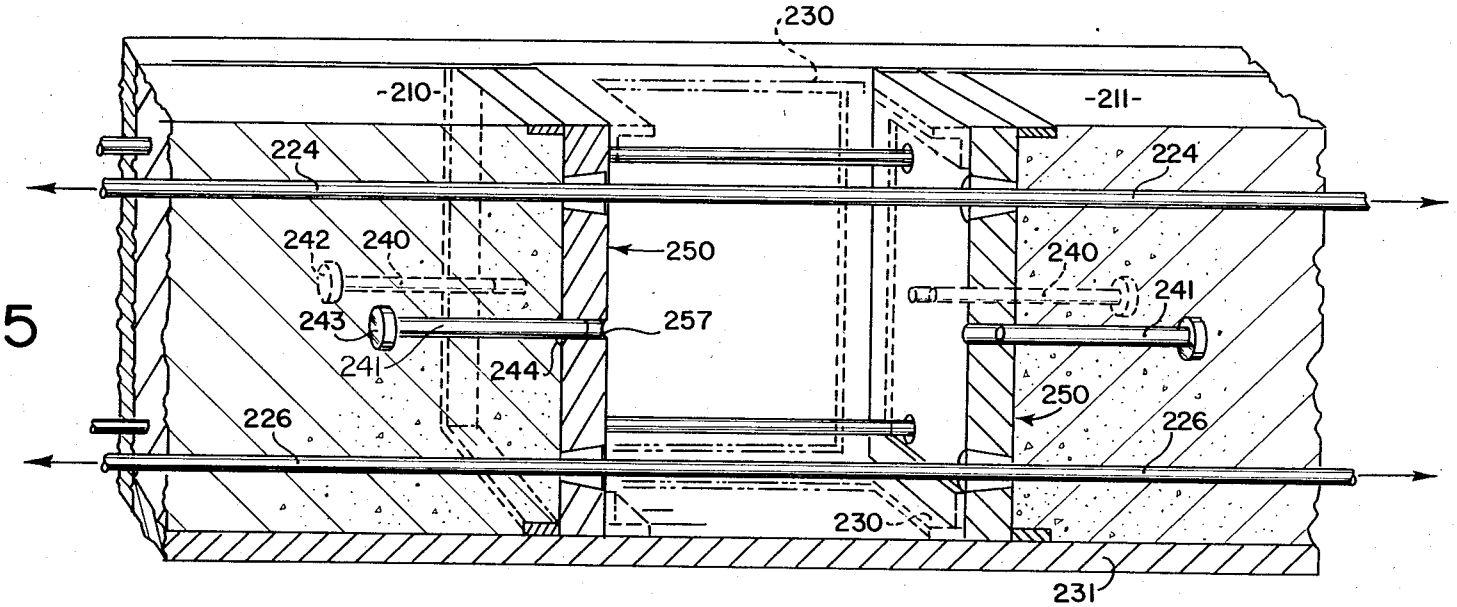
FIG. 5 is a perspective view, partially in section, of one embodiment of this invention used in a casting form.

FIG. 5 shows a schematic representation of prestressed concrete piling being formed in a casting yard. The ends of two piles 210 and 211 are shown. Strands 224 and 226 extend through the lengths of piles 210 and 211 and are prestressed in the direction of the arrows shown in FIG. 5.

Figure 6:
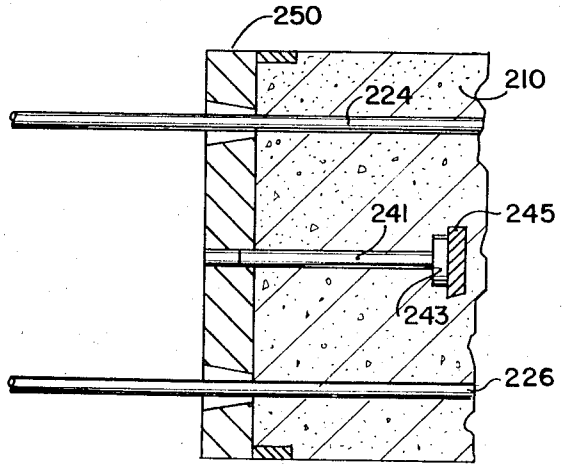
FIG. 6 is a sectional view of a portion of the apparatus shown in FIG. 5.

A plate means 250 is applied to the end of the casting for each of piles 210 and 211. A bulkhead 230 is shown which serves to support the plate means 250 in position as the concrete is poured into casting form 231. Anchors 240 and 241 are provided, each having a stem portion and a disc shaped end 242 and 243. The stem portion is inserted into centering hole 257 and welded as shown by bead 244 to plate means 250. The anchors 240 and 241 keep plate means 250 in position after the concrete has set up and prior to the retensioning of strands 224 and 226. As shown best in FIG. 6, a compressible spacer 245 is provided at the end of each anchor, so that the compressive forces during a pile driving operation will not be transmitted directly from the end 243 of anchor 241 into the concrete of pile 210, which could easily cause failure of the end of pile 210 during the pile driving operation. A compressible spacer is applied to each anchor prior to the casting operation, but are not shown in FIG. 5. After the concrete has set up, strands 224 and 226 are cut, leaving exposed ends as shown in FIG. 6. Pile 210 as shown in FIG. 6 can be transported from the casting yard to the job site prior to the retensioning operation of the ends of stands 224 and 226. Alternatively, after pile 210 has been removed from the casting form 231, the retensioning operation can be performed at the casting yard, for example, and pile 210 shipped to the job site with the ends of all strands retensioned and cut off flush with the end of plate means 250.

Figure 7:
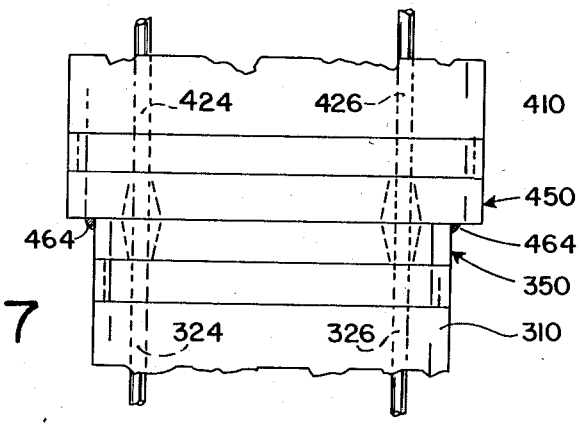
FIG. 7 is an elevational view showing a composite pile formed by the splice provided by this invention.

FIG. 7 shows how a smaller sized piling 310 may be spliced to a larger piling 410 utilizing this invention. Plate means 350 and 450 are applied to the ends of piles 310 and 410 respectively, the ends of strands 324 and 326, 424 and 426 are retensioned as described above and cut off flush with the ends of plate means 350 and 450 and a continuous bead of welding is applied as shown at 464 to complete the splice.

Figure 8:
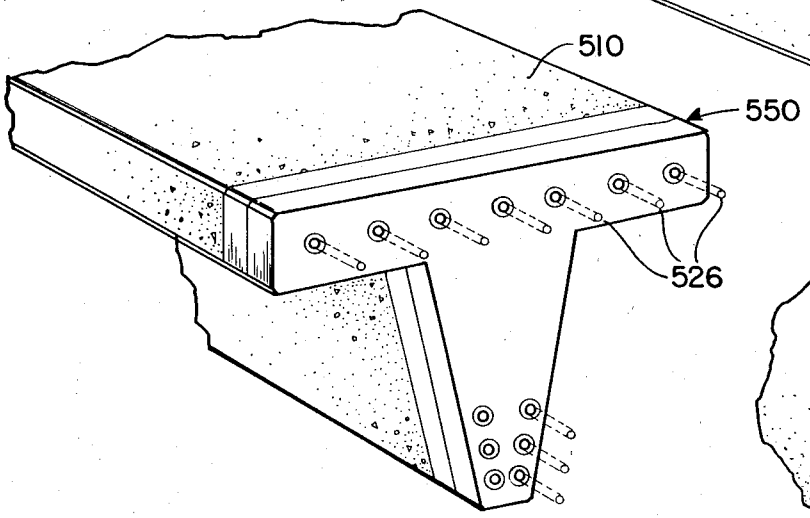
FIG. 8 is a perspective view of an alternate prestressed concrete member utilizing another embodiment of the invention.

FIG. 8 shows yet another shaped prestressed concrete member 510 utilizing plate means 550 to cover the end of member 510 and to receive the ends of the strands 526, which are retensioned as described above. Member 510 may be used as a floor joist, for example, after the ends of strands 526 have been retensioned and cut off flush with the edge of plate means 550. Alternatively, the ends of strands 526 may be connected to other reinforcing material in wall structures to support member 510 as a floor joist.

Figure 9:
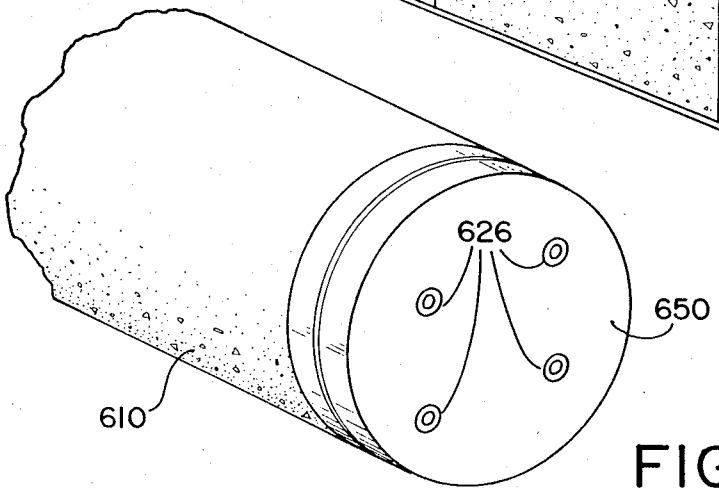
FIG. 9 is a perspective view of a circular concrete member utilizing the invention.

FIG. 9 shows a circular cross sectioned concrete member which may be used as a light pole, for example. Plate means 650 is designed to receive the strands 626 which extend through the length of concrete member 610.

Figure 10:
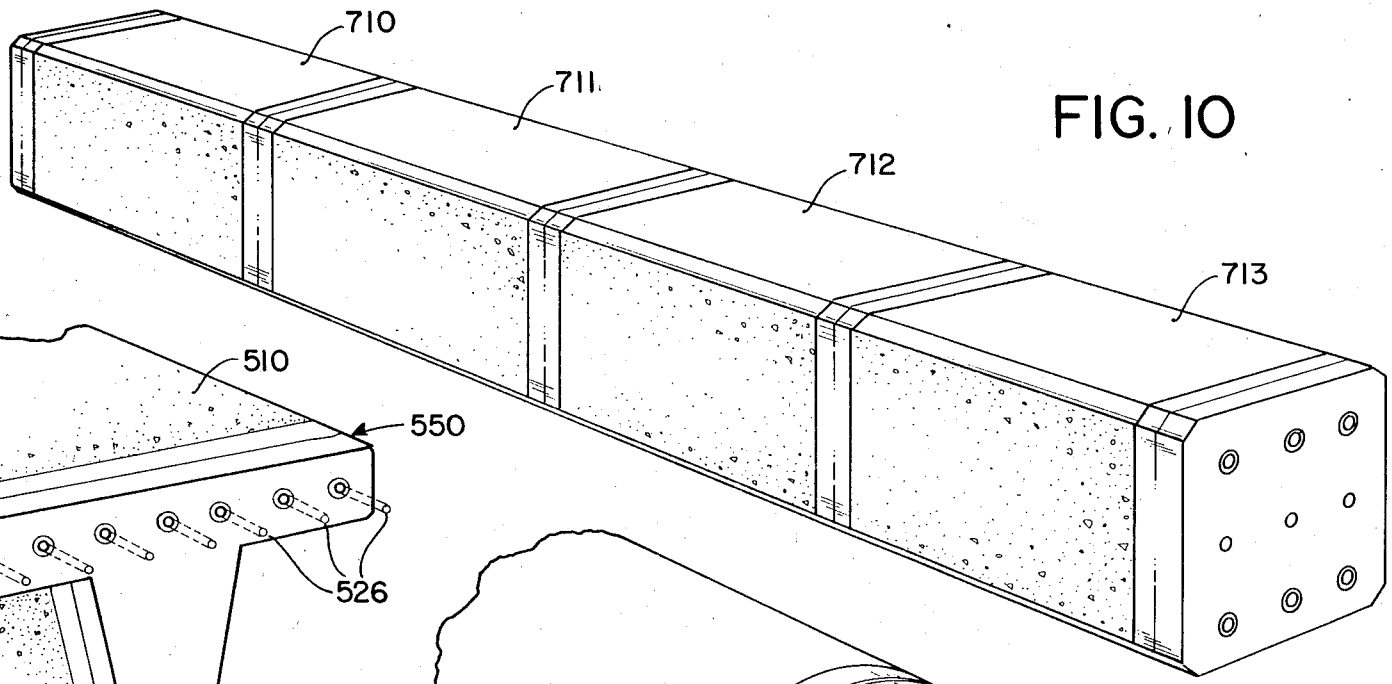
FIG. 10 is a perspective view of a column made up of several shorter columns joined together by the splice provided by this invention.

FIG. 10 shows a pile which comprises sections 710, 711, 712 and 713 which have been spliced together to form a usable pile. The splice of this invention may be used in this fashion to salvage otherwise unusable sections of piling, thereby saving the expense and inconvenience involved in disposing of the otherwise unusable short lengths of piling.

Figure 11:
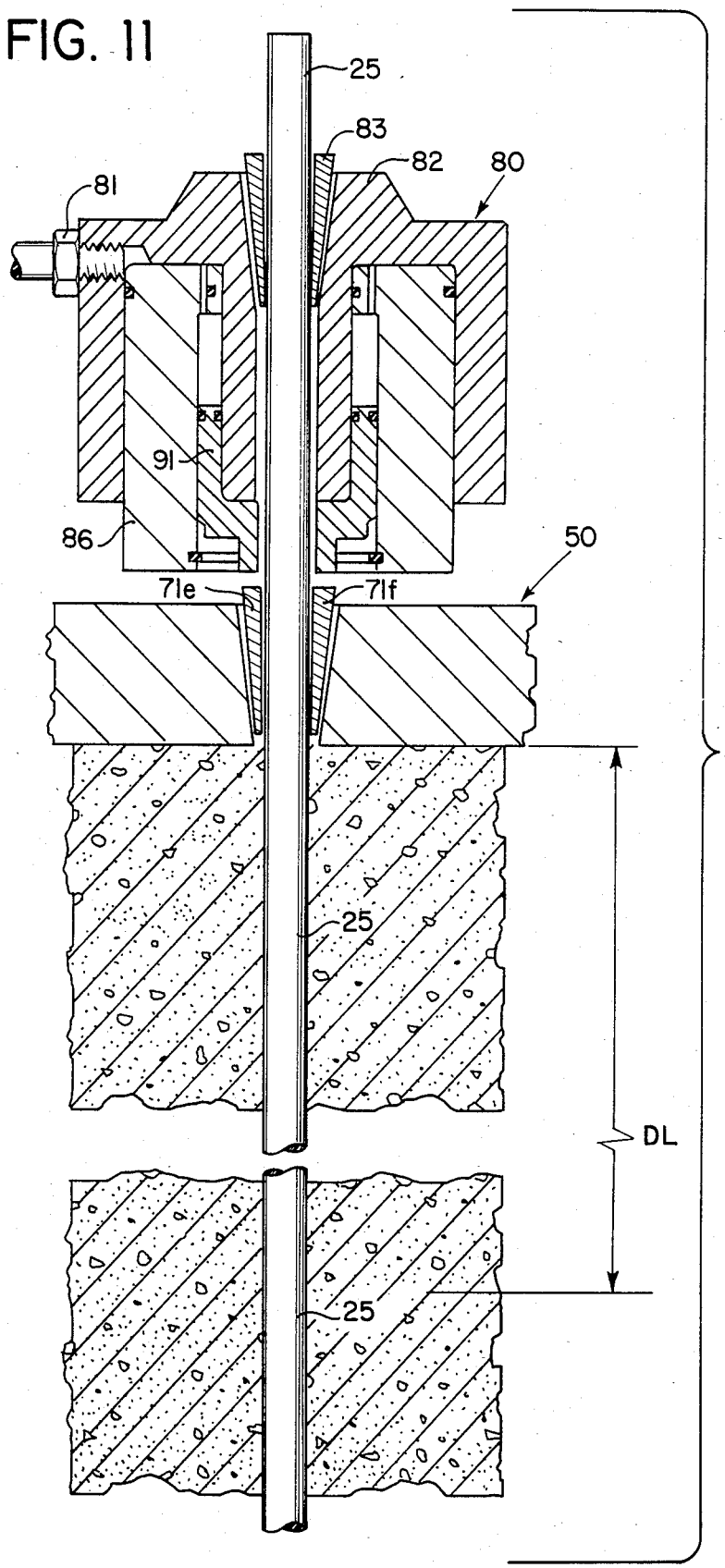
FIG. 11 is a sectional view of a concrete member in which the jack is being applied.
Figure 12:
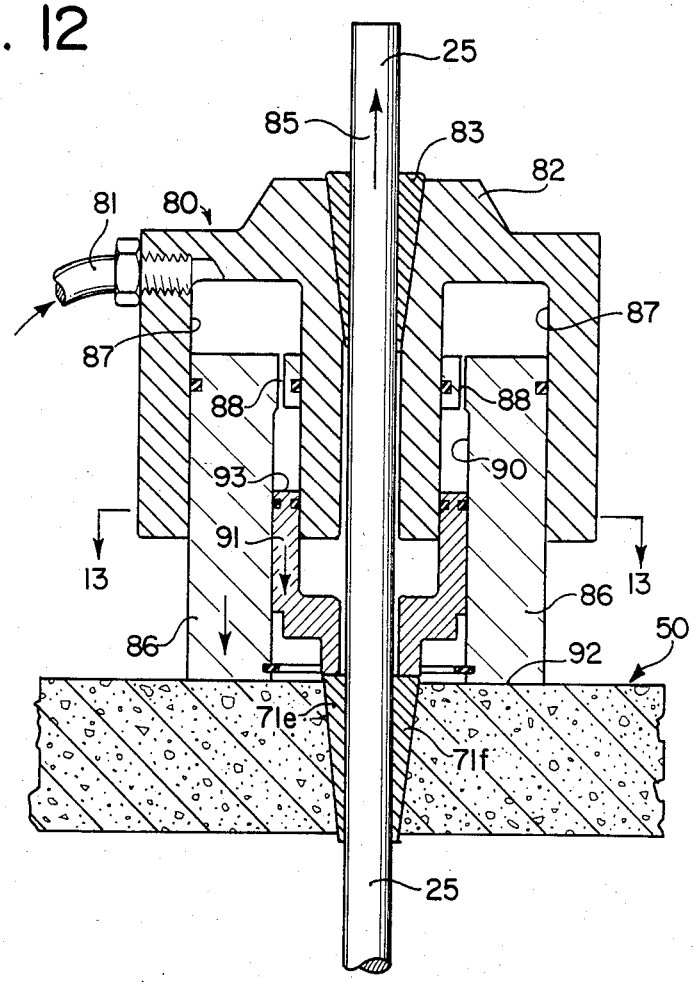
FIG. 12 is a sectional view showing the jack in operation.
Figure 13:
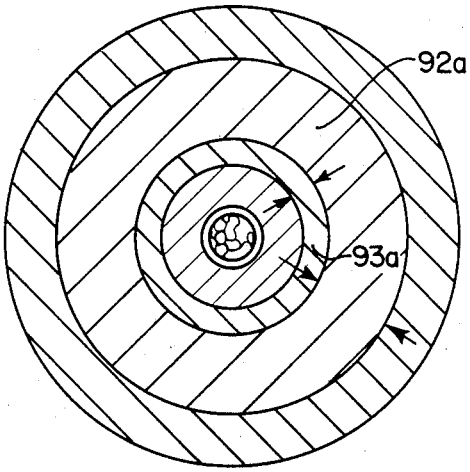
FIG. 13 is a sectional view of the interior of the jack provided by this invention.

FIG. 11 and FIG. 12 show the detailed operation of jack means 80. FIG. 11 shows jack means 80 as it is being lowered into position on the end of strand 25. Retaining wedges 71*e* and 71*f* are shown in position prior to the retensioning of strand 25. FIG. 12 shows the retensioning operation. As pressure is built up in the incoming hydraulic line 81 (by pump 97 shown in FIG. 1), the seat 82 of jack means 80 engages tapered restraining chuck 83 which grips the end of strand 25 and retensions the end 25 in the direction of arrow 85. Outer ram 86 is driven against plate means 50 by the hydraulic pressure which builds up in chamber 87. Passageway 88 in outer ram transmits the pressurized hydraulic fluid into chamber 90 which drives inner ram 91 against retaining wedges 71*e* and 71*f*. The relative forces applied by the outer ram 86 and inner ram 91 are determined by the cross sections of the ends of those rams 92 and 93 shown best in FIG. 12. FIG. 13 shows the effective cross-sectional areas 92*a* and 93*a* of rams 86 and 91 respectively. We have found that the ratio of those areas should be approximately 6 to 1 so that when 30 kips is applied to strand 25, approximately 5 kips is applied to retaining wedges 71*e* and 71*f*.

Centering pins 40 may be used to assist in splicing two concrete members together. For example, in FIG. 1, centering pins 40 having a lower cylindrical portion 41 are slid into holes 57 and 59. The centering pins also have a tapered upper portion 42 that serves to guide and align the plate means 150 of member 110 with plate means 50 of member 10 as shown in FIG. 4.

We claim:

1. A method of retensioning the development length of pre-tensioned strands embedded in and bonded to the concrete of an elongated, prestressed concrete member comprising the steps of:

(1) exposing any unexposed ends of said pre-tensioned strands at one end of the prestressed concrete member, (2) covering said one end of said concrete member with a plate having holes therein through which the ends of said pre-tensioned strands can pass, (3) applying retaining wedges between the ends of said pre-tensioned strands and said plate, and (4) retensioning each pre-tensioned strand by applying a predetermined amount of tension to the end of each such strand and maintaining said tension between the end of said pre-tensioned strand and said plate by said retaining wedges.

2. A method of splicing together two elongated, prestressed concrete members each having pre-tensioned strands embedded therein and bonded to the concrete of the prestressed concrete member, said method comprising the steps of:

(1) exposing any unexposed ends of said pre-tensioned strands at one end of each of said concrete members to be spliced, (2) covering said one end of each of said concrete members to be spliced with a plate having holes therein through which the ends of said pre-tensioned strands can pass, (3) applying retaining wedges between the ends of said pre-tensioned strands and each of said plates, (4) retensioning each pre-tensioned strand by applying a predetermined amount of tension to the exposed end of each such strand and maintaining said tension between the end of said pre-tensioned strand and said plate by said retaining wedges, and (5) joining the plates together permanently.

3. A device for retensioning the development length of pre-tensioned strands embedded in and bonded to the concrete of an elongated, prestressed concrete member wherein the ends of said strands are exposed at one end of said member comprising:

plate means having a plurality of holes therein through which the exposed ends of said strands pass, and retaining means carried by said plate means for engaging said exposed end of strand such that said strand may only move in a direction in which tension in said strand is increased, hydraulic jack means for applying tension to the ends of said exposed strands by gripping the end of an exposed strand and applying pressure to said plate means, such that as tension is increased in said strand, said strand moves through said retaining means until a predetermined tension is developed in said strand, said hydraulic jack means including hydraulically actuated means for urging said retaining means into engagement with said exposed end of the strand.

4. The device of claim 3 in which said plate means comprises:

a flat plate having a plurality of tapered holes to receive said retaining means, and a skirt extending around the periphery of said plate.

5. The device of claim 4 further comprising:

a plurality of anchors connected to said plate, and compressible spacer means connected to the ends of said anchors to resist failure of said concrete member by said transmission of compressive forces through the ends of said anchors into said concrete member.

6. Apparatus for splicing together two elongated, prestressed concrete members each having pre-tensioned strands embedded therein and bonded to the concrete of the prestressed concrete member, with each member having ends of its strand exposed, said apparatus comprising:

plate means for each of said two concrete members, each plate means having a plurality of holes therein through which the exposed ends of strands pass, retaining means carried by each of said plate means engaging said exposed end of strand such that said strand may only move in a direction in which tension in said strand is increased, and connection means for permanently joining said plate means together.

7. The apparatus of claim 6 wherein each of said plate means has a skirt and is applied to the end of said concrete member when the member is cast and wherein said connection means is a continuous weld around the periphery of said plate means, such that said retaining means are effectively sealed from the elements.

8. A method of retensioning the development length of pre-tensioned strands embedded in and bonded to the concrete of an elongated, prestressed concrete member comprising the steps of:

(1) exposing any unexposed ends of said pre-tensioned strands at one end of the prestressed concrete member, (2) covering said one end of said concrete member with a plate having holes therein through which the ends of said pre-tensioned strands can pass, (3) applying retaining wedges between the ends of said pre-tensioned strands and said plate, and (4) retensioning each pre-tensioned strand by applying a predetermined amount of tension to the end of each such strand and maintaining said tension between the end of said pre-tensioned strand and said plate by said retaining wedges, said application of tension being peformed sequentially among the strands.

9. A method of splicing together two elongated, prestressed concrete members each having pre-tensioned strands embedded therein and bonded to the concrete of the prestressed concrete member, said method comprising the steps of:

(1) exposing any unexposed ends of said pre-tensioned strands at one end of each of said concrete members to be spliced, (2) covering said one end of each of said concrete members to be spliced with a plate having holes therein through which the ends of said pre-tensioned strands can pass, (3) applying retaining wedges between the edges of said pre-tensioned strands and each of said plates, (4) retensioning each pre-tensioned strand by applying a predetermined amount of tension to the exposed end of each such strand and maintaining said tension between the end of said pre-tensioned strand and said plate by said retaining wedges, said application of tension being performed sequentially among the strands, and (5) joining the plates together permanently.

10. A method of retensioning the development length of pre-tensioned strands embedded in and bonded to the concrete of an elongated, prestressed concrete member with the ends of the pre-tensioned strands being exposed at one end of the prestressed concrete member, said method comprising the steps of:

(1) covering said one end of said concrete member with a plate having holes therein through which the exposed ends of said pre-tensioned strands can pass, (2) applying retaining wedges between the exposed ends of said pre-tensioned strands and said plate, and (3) retensioning each pre-tensioned strand by applying a predetermined amount of tension to the exposed end of each such strand and maintaining said tension between the exposed end of said pre-tensioned strand and said plate by said retaining wedges.

11. A method of splicing together two elongated, prestressed concrete members each having pre-tensioned strands embedded therein and bonded to the concrete of the prestressed concrete member with said pre-tensioned strands each having an exposed end at one end of the prestressed concrete member, said method comprising the steps of:

(1) covering said one end of each of said concrete members to be spliced with a plate having holes therein through which the exposed ends of said pre-tensioned strands can pass, (2) applying retaining wedges between the exposed ends of said pre-tensioned strands and each of said plates, (3) retensioning each pre-tensioned strand by applying a predetermined amount of tension to the exposed end of each such strand and maintaining said tension between the end of said pre-tensioned strand and said plate by said retaining wedges, and (4) joining the plates together permanently.

12. A method of retensioning the development length of pre-tensioned strands embedded in and bonded to the concrete of an elongated, prestressed concrete member having the ends of the pre-tensioned strands exposed at one end of the prestressed concrete member, said method comprising the steps of:

(1) covering said one end of said concrete member with a plate having holes therein through which the exposed ends of said pre-tensioned strands can pass, (2) applying retaining wedges between the exposed ends of said pre-tensioned strands and said plate, and (3) retensioning each pre-tensioned strand by applying a predetermined amount of tension to the exposed end of each such strand and maintaining said tension between the exposed end of said pre-tensioned strand and said plate by said retaining wedges, said application of tension being performed sequentially among the strands.

13. A method of splicing together two elongated, prestressed concrete members each having pre-tensioned strands embedded therein and bonded to the concrete of the prestressed concrete member with said pre-tensioned strands each having an exposed end at one end of the prestressed concrete member, said method comprising the steps of:

(1) covering said one end of each of said concrete members to be spliced with a plate having holes therein through which the exposed ends of said pre-tensioned strands can pass, (2) applying retaining wedges between the exposed ends of said pre-tensioned strands and each of said plates, (3) retensioning each pre-tensioned strand by applying a predetermined amount of tension to the exposed end of each such strand and maintaining said tension between the end of said pre-tensioned strand and said plate by said retaining wedges, said application of tension being performed sequentially among the strands, and (4) joining the plates together permanently.

* * * * *